US005925003A

United States Patent [19]

Vincent et al.

[11] Patent Number: 5,925,003

[45] Date of Patent: Jul. 20, 1999

[54] ADJUSTABLE NON-POWERED ORTHOPEDIC TRACTION DEVICE

[75] Inventors: Rodney Vincent, Bellair, Fla.; Marco Herrera Parrales, San Jose, Costa Rica

[73] Assignee: Manualidades de Mimbre de Costa Rica, S.A., San Jose, Costa Rica

[21] Appl. No.: 08/911,336

[22] Filed: Aug. 14, 1997

[51] Int. Cl.[6] ..... A61H 7/00

[52] U.S. Cl. ..... 601/134; 601/28

[58] Field of Search ..... 601/24, 28, 39, 601/95, 103, 104, 122, 133–7; 482/142; 5/630; 297/452.29, 452.3, 452.31, 452.32, 452.45

[56] References Cited

U.S. PATENT DOCUMENTS

| | | | |
|---|---|---|---|
| 3,107,665 | 10/1963 | Nordgren | 128/60 |
| 4,189,182 | 2/1980 | Rhoe . | |
| 4,421,110 | 12/1983 | DeLisle et al. | 128/60 |
| 5,328,245 | 7/1994 | Marks et al. . | |
| 5,584,786 | 12/1996 | Almeda . | |
| 5,674,185 | 10/1997 | Chang | 601/122 |
| 5,722,102 | 3/1998 | Summers | 5/630 |
| 5,797,861 | 8/1998 | Port | 601/134 |

*Primary Examiner*—Danton D. DeMille
*Attorney, Agent, or Firm*—Larson & Larson, P.A.; James E. Larson

[57] ABSTRACT

An orthopedic traction device includes a frame having two side supports spaced from one another to provide an open area between them. Each of the side supports has a flat bottom wall and an arcuately shaped upper wall. Between the side supports, two rows of spaced protuberances are provided, with each row being arcuately disposed in a manner generally parallel to the arcuately shaped upper walls of the two side supports. Each row consists of a multiplicity of spaced generally rectangular protuberances with each rectangular protuberance being elongated in a direction perpendicular to the axis of elongation of the frame. Between adjacent protuberances, a scalloped portion is provided. The radius of curvature of each row of spaced protuberances varies from a relatively large radius of curvature adjacent one end of the rows to a smaller radius of curvature at the other end thereof.

10 Claims, 4 Drawing Sheets

ADJUSTABLE NON-POWERED ORTHOPEDIC TRACTION DEVICE

BACKGROUND OF THE INVENTION

The present invention relates to a traction device. In many cases, postural mechanical spine pain and pain in appendages is caused by the fact that standing erect causes, over time, shortening of the distances between adjacent vertebra with concurrent squeezing of disks between adjacent vertebra and the resultant compression of nerve endings that cause pain sensation.

The medical industry has been able to do little to reduce the amount of suffering from postural mechanical spine pain. A cyclical effect occurs when repetitive motions and mechanical loads create muscular tension in the spine and body appendages. These sensitized tensions are further compounded by additional stress and strain, resulting in muscular-skeletal breakdown and postural mechanical spine pain. Most people cannot stop their daily activities that may be responsible for creation of tension in the spine. Accordingly, most people experience low-back, shoulder and neck pain that require a myriad of remedies employed in an attempt to ease pain. At present, the main remedies consist of prescribing of drugs, bed rest, or in severe cases, performance of surgery. Surgery can be expensive and the recuperation time can be extensive. Often, a patient cannot afford to rest in bed for the time period necessary to heal a postural mechanical spine injury. Of course, drugs prescribed to alleviate such spine pain may be highly addictive, leaving the patient with a residual problem once such spine pain has been alleviated.

As such, a need has developed for a device that can not only alleviate spine pain and pain in related appendages but also can be used by a healthy patient to prevent or delay the onset of spine pain. It is with this need in mind that the present invention was developed.

Applicant is aware of PCT application PCT/GB95/00155 to Summers that discloses a back rest device including an arcuate back supporting portion made up of two parallel rows of upstanding rectangular members laterally spaced from one another by respective scalloped recesses. The scalloped recesses are designed to receive the vertebra of the user and the rectangular portions are designed to support portions of the user's back to either side thereof. Summers discloses that his device may be usable while sitting in a chair. The present invention differs from the teachings of Summers as contemplating two spaced rows of protuberances with an elongated slot therebetween free of scalloped recesses and with adjacent protuberances in each row being spaced with scalloped recesses in the axial direction. The present invention also contemplates the use of pressure intensity adjusting infills positioned laterally outwardly of the rows of protuberances to facilitate support of muscle tissues of the back.

Applicant is also aware of U.S. Pat. No. 4,189,182 to Rhoe and U.S. Pat. No. 5,328,245 to Marks et al. The present invention differs from the teachings of these references for the reasons set forth above concerning the PCT application to Summers.

SUMMARY OF THE INVENTION

The traction device of the present invention includes the following interrelated objects, aspects and features:

(1) In a first aspect, the present invention includes a frame having two side supports spaced from one another to provide an open area therebetween. Each of the side supports has a flat bottom wall and an arcuately shaped upper wall for a purpose to be described in greater detail hereinafter.

(2) Between the side supports, two rows of spaced protuberances are provided, with each row being arcuately disposed in a manner generally parallel to the arcuately shaped upper walls of the two side supports. Each row consists of a multplicity of spaced generally rectangular protuberances with each rectangular proruberance being elongated in a direction perpendicular to the axis of elongation of the frame. Between adjacent protuberances a scalloped portion is provided.

(3) Between each row and the most adjacent side support, a pressure intensity adjusting infill may selectively be received, if desired, to support soft tissue adjacent the spinal column.

(4) In the use of the present invention, it is placed on a floor surface with the flat bottom walls of the side supports sitting thereon. Initially, the pressure intensity adjusting infills are inserted in their spaces and the user lies down on top of the rows of spaced protuberances with the spinal column aligned between these adjacent rows. The positioning of the user along the longitudinal axis of the traction device will be described in greater detail hereinafter. After the user has been using the inventive traction device for awhile, the pressure intensity adjusting infills may be removed so that greater pressure can be brought to bear on the user's spine. The radius of curvature of each row of spaced protuberances varies from a relatively large radius of curvature adjacent one end of the rows to a smaller radius of curvature at the other end thereof.

Accordingly, it is a first object of the present invention to provide a traction device.

It is a further object of the present invention to provide such a device including a pair of parallel rows of spaced protuberances with the rows being spaced apart by an open area therebetween.

It is a further object of the present invention to provide such a device including means for receiving pressure intensity adjusting infills outside each row.

It is a yet further object of the present invention to provide such a device wherein the curvature of the rows of protuberances along the axis of elongation of the device varies from one end to the other.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
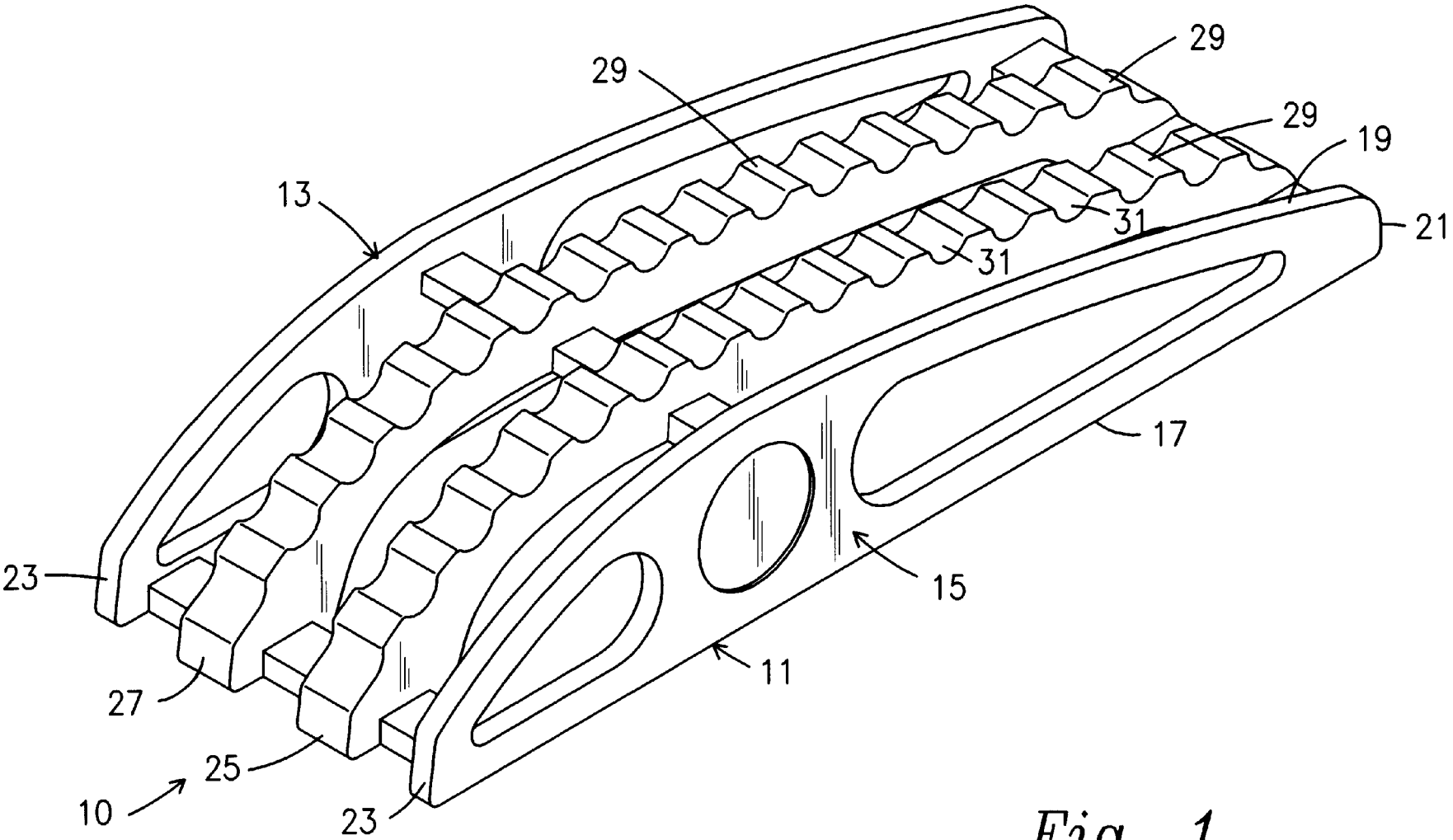
FIG. 1 shows a perspective view of the present invention.

With reference, first, to FIG. 1, the present invention is generally designated by the reference numeral 10 and includes a frame 11 including two side supports 13 and 15 that are parallel with one another and spaced to form an open area therebetween.

Each of the side support, 13, 15 includes a flat bottom wall 17 designed to sit on a ground surface and an arcuately curved upper wall 19 having a radius of curvature that varies from one end 21 to the other end 23 thereof. In particular, with reference to FIGS. 1, 3 and 4, it is seen that the radius of curvature of the upper wall 19 is greater adjacent the end 21 thereof and gradually reduces in radius of curvature to the smallest radius of curvature adjacent the end 23 thereof.

Figure 2:
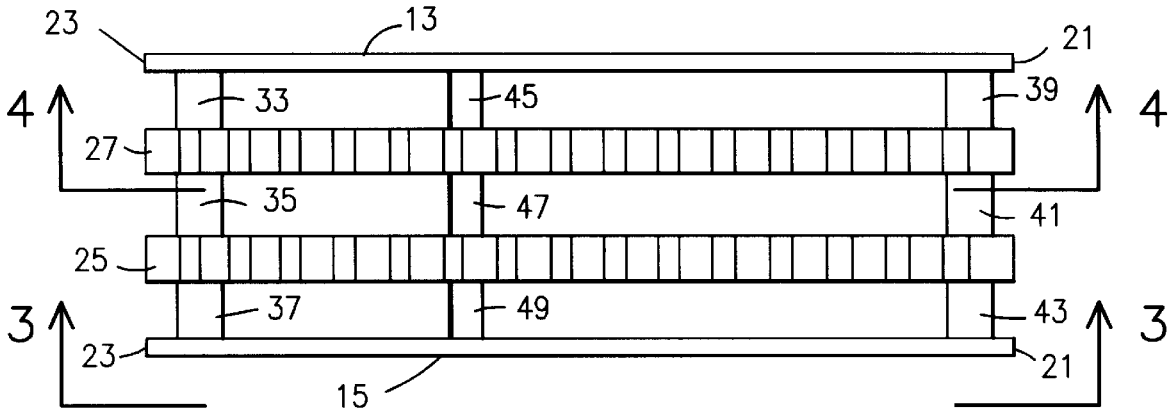
FIG. 2 shows a top view of the present invention.

With particular reference to FIGS. 1 and 2, it is seen that disposed between the supports 13 and 15 are two spaced rows 25 and 27 of protuberances 29. The protuberances 29 are designed to put pressure on muscles and nerve endings adjacent the spinal column for therapeutic purposes.

As should be understood from the figures, the axis of elongation of the inventive traction device 10 is parallel to the longitudinal extent of elongation of the side supports 13 and 15. The rectangular protuberances 29 are elongated, as seen in the figures, in a direction perpendicular to the axis of elongation of the device 10. As best seen in FIG. 1, between each respective pair of adjacent protuberances 29, a scalloped recess 31 is provided. The scalloped recess 31 is provided since it is undesirable to exert pressure on the entirety of the back surface adjacent the spinal column. It has been found that exerting pressure on selected regions of the tissues adjacent the spinal column while leaving other areas untensioned allows achievement of enhanced therapeutic results.

Figure 3:
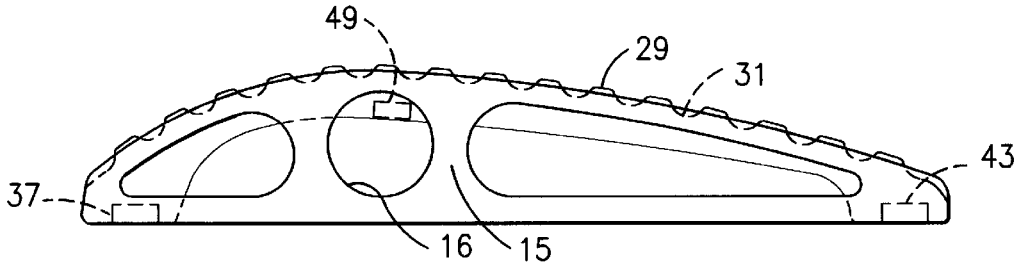
FIG. 3 shows a side view of the present invention.
Figure 4:
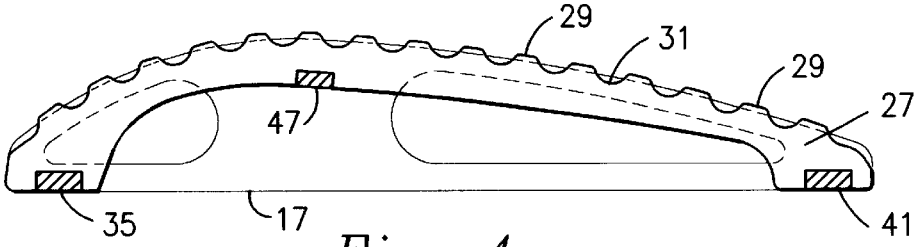
FIG. 4 shows a cross-sectional view along the line 4—4 of FIG. 3.

With particular reference to FIG. 2, it is seen that the side supports 13, 15 and rows 25 and 27 are rigidly assembled together by lateral cross supports visible as sections 33, 35 and 37 adjacent the ends 23 of the supports 13 and 15, sections 39, 41 and 43 adjacent the ends 21 thereof and intermediately placed sections 45, 47 and 49. FIG. 4 particularly shows the sections 35, 47 and 41, especially their positions with respect to the profile of the row 27. FIG. 3 shows the sections 37, 49 and 43, with the sections 37, 43 and 49 being shown in phantom. An indentation 16 in the support 15 is used to receive an indentification decal. Cross members may be mounted in place by any suitable means depending upon particular materials from which the inventive traction device 10 is made. Thus, for example, the cross members may be placed in the manner shown in particular in FIG. 2 through welding, bolting, nails or other fasteners, gluing or any other suitable means.

Figure 5:
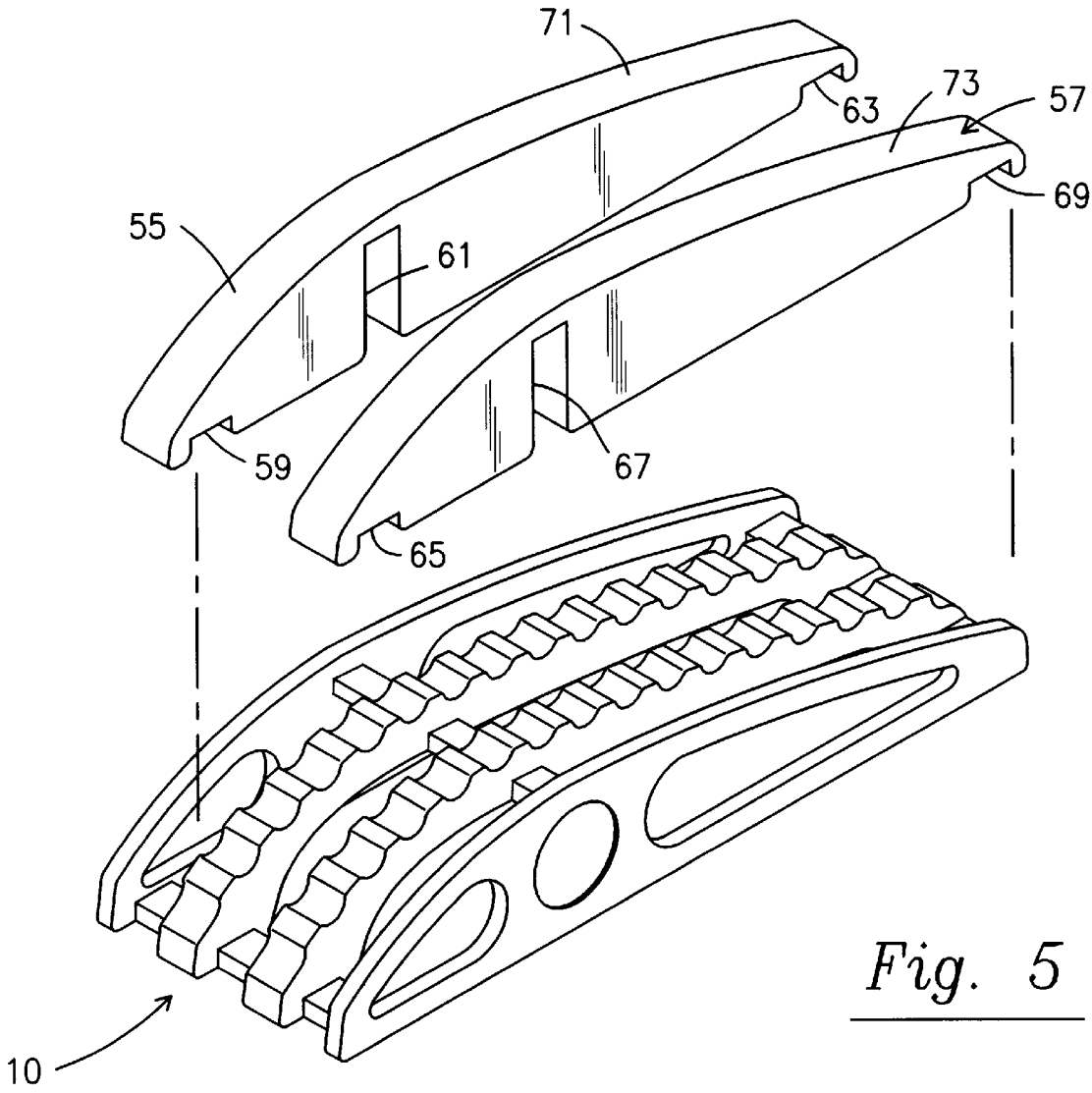
FIG. 5 shows an exploded perspective view showing pressure intensity adjusting infills usable in accordance with the teachings of the present invention.
Figure 6:
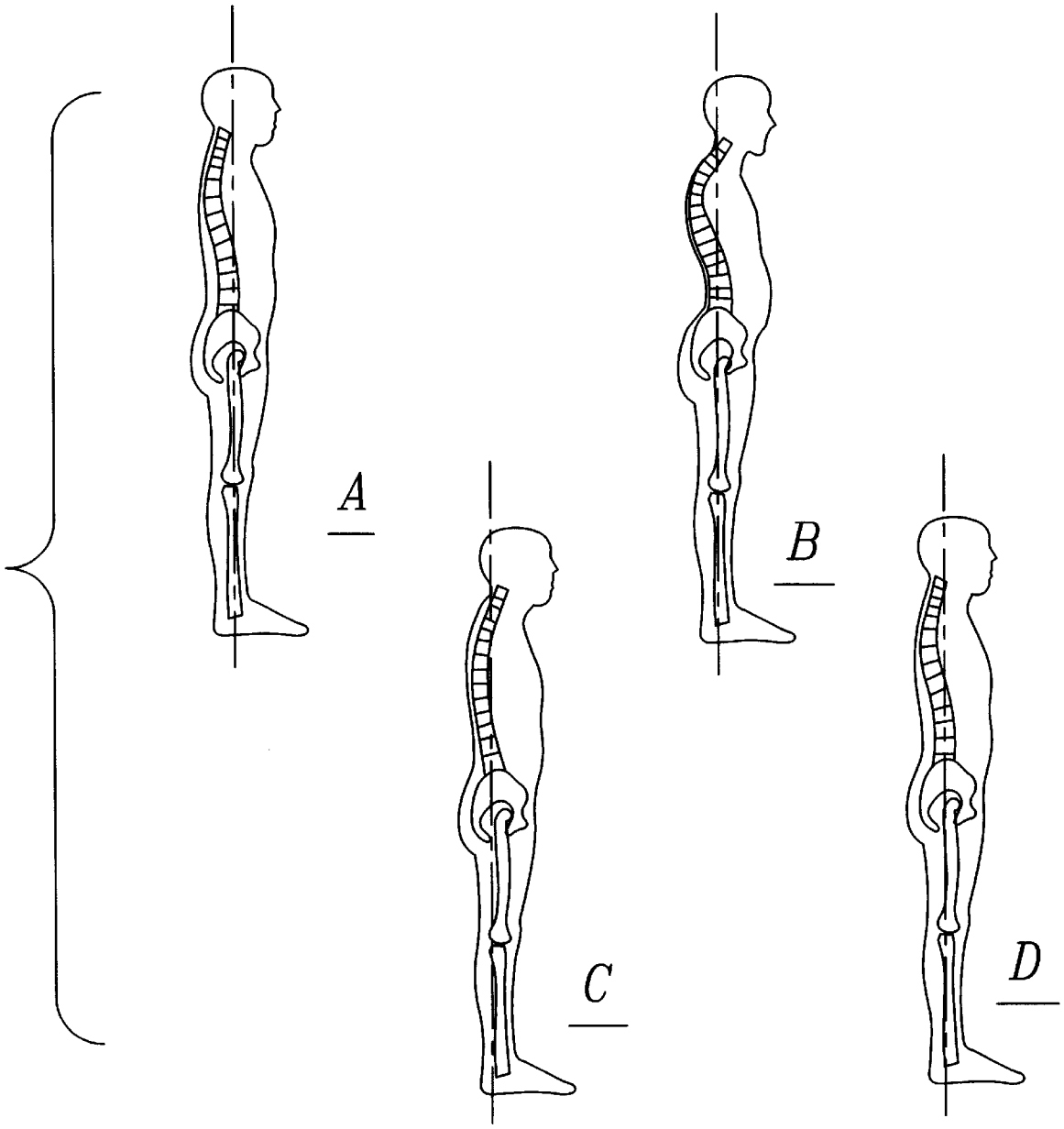
FIG. 6 shows schematic side views of four typical human postures labeled A ,B, C and D, respectively.

With reference to FIG. 5, the present invention also may include pressure intensity adjusting infills 55 and 57 with the infill 55 being adapted to be received between the row 27 and the support 13 and with the infill 57 being adapted to be received between the row 25 and the support 15. As seen in FIG. 5, the infill 55 includes recesses 59, 61 and 63 that are provided to allow receipt of the sections 33, 45 and 39, respectively. Similarly, the insert 57 includes recesses 65, 67 and 69 that are provided to respectively receive the sections 37, 49 and 43. As can be seen in FIG. 5, the infills 55 and 57 include respective arcuately shaped upper walls 71 and 73 that bear the same curvature as the upper walls 19 of the side supports 13 and 15. When the infills 51 and 57 are inserted into the device 10 in the manner described, the upper walls 71 and 73 provide support for soft tissues laterlly disposed with respect to the spinal FIG. 6 shows side views of four different basic postures that are typically observed in human beings. These postures are labeled with the letters A, B, C and D.

In the use of the inventive traction device, one must first determine which posture type as depicted in FIG. 6 most closely resembles the posture type of the user. Should the posture type of the user most closely resemble that which is depicted by the letter C in FIG. 6, then the user should start using the inventive device 10 with the area of smallest radius of curvature, adjacent the ends 23 of the supports 13 and 15 nearer to the lower back and with the head in the direction of the other end 21 of the side supports 13 and 15. If the posture of the user more closely resembles those typical postures depicted in FIG. 6 by letters A, B and D, the user should begin with the area of larger radius of curvature near the ends 21 of the side supports 13 and 15 adjacent the lower back and with the head of the user directed more closely toward the ends 23 of the supports 13 and 15.

When the inventive device is first being used, it might be advantageous to insert the pressure intensity adjusting infills 55 and 57 in the manner depicted in FIG. 5 to relieve strain on those portions of the back lying laterally adjacent the spinal column. Eventually, when it is desired to allow additional pressure to be brought to bear upon those tissues laterally adjacent the spinal column, the infills 55 and 57 may be removed and the inventive device 10 may be employed without them. In the preferred embodiment of the present invention, the infills 55 and 57 are made of a hard polyurethane foam or like polymer substance.

Once the appropriate starting posture has been determined, including the direction of orientation of the inventive device 10 with respect to the user, the traction device 10 is placed on a flat floor surface and the user lies down lengthways on the device 10 with the spinal column aligned between the rows 25 and 27. As an example of a recommended routine, for the first ten days, the user should lay on the inventive device for two to five minutes at a time two to three times a day. As this routine becomes more comfortable, the user may then use the inventive device for ten to twenty minutes once a day. This routine should be adhered to for a period of at least ten weeks.

Since some people are less flexible than others, it may take some people a longer period of time to achieve the maximum level of tension release. If desired, a pillow may be used under the head of the user to prevent too much stretching action in the neck region. Once the appropriate flexibility has been achieved, use of the pillow may be stopped.

The inventive device 10 in addition to relieving spinal and back discomfort and pain, is effective in alleviating leg cramps, muscle spasms, sciatica, tennis elbow etc., caused by spinal nerve pressure. It also relieves headaches, tension, stress and relief from fatigue and depression caused by spinal nerve pressure.

The inventive device 10 may be made of any suitable material such as wood, metal or plastic or any combination thereof.

Accordingly, an invention has been disclosed in terms of a preferred embodiment thereof which fulfills each and every one of the objects of the invention as set forth hereinabove and provides a new and useful traction device of great novelty and utility Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. An adjustable non-powered orthopedic traction device, comprising:

a) a frame having a longitudinal axis of elongation including two spaced side supports with an arcuate upper wall, the side supports defining an opening therebetween, each side support including a bottom wall adapted to engage a floor surface;

b) two parallel spaced arcuate rows disposed in said opening between said supports, each row including a multiplicity of protuberances spaced along said axis with a scalloped recess between each protuberance; and c) a continuous opening between said rows together with a continuous opening between each side support and closest row.

2. The device of claim 1, wherein each of said arcuate rows has a curvature that continuously varies from a relatively large radius of curvature adjacent one end to a relatively small radius of curvature adjacent another end.

3. The device of claim 1, wherein each protuberance is generally rectangular.

4. The device of claim 3, wherein each generally rectangular protuberance is elongated in a direction perpendicular to said axis.

5. The device of claim 1, wherein said side supports and rows are parallel and attached by three spaced apart lateral cross supports.

6. An adjustable non-powered orthopedic traction device, comprising:

a) a frame having a longitudinal axis of elongation including two spaced parallel side supports defining an opening therebetween, each side support including a planar bottom wall adapted to engage a floor surface and an arcuate upper wall;

b) two spaced arcuate parallel rows disposed in said opening between said supports, each row including a multiplicity of rectangular protuberances spaced along said axis by respective scalloped recesses; and c) a continuous opening between said rows together with a continuous opening between each side support and closest row.

7. The device of claim 6, wherein each of said arcuate rows has a curvature that continuously varies from a relatively large radius of curvature adjacent one end to a relatively small radius of curvature adjacent another end.

8. The device of claim 6, wherein each generally rectangular protuberance is elongated in a direction perpendicular to said axis.

9. An adjustable non-powered orthopedic traction device, comprising:

a) two spaced arcuate rows, each row including a multiplicity of generally rectangular protuberances spaced therealong with a scalloped recess between each respective pair of adjacent protuberances;

b) each row having a curvature that continuously varies from a relatively large radius of curvature adjacent one end to a relatively small radius of curvature adjacent another end;

c) each row spaced apart from an exterior frame side support having a longitudinal axis of elongation parallel to the two spaced arcuate rows; and d) each row joined by lateral cross supports to the exterior frame side supports.

10. The device of claim 9, wherein said rows are parallel and extend along an axis of elongation, each generally rectangular protuberance being elongated in a direction perpendicular to said axis.

* * * * *